US006035825A

United States Patent [19]

Worth et al.

[11] Patent Number: 6,035,825

[45] **Date of Patent: *Mar. 14, 2000**

[54] CONTROL OF FUELING RATE OF AN ENGINE

[75] Inventors: David Richard Worth, Shenton Park; Richard William Hurley, Woodvale, both of Australia

[73] Assignee: Orbital Engine Company (Australia) Pty Limited, Balcatta, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 09/243,134

[22] Filed: Feb. 3, 1999

Related U.S. Application Data

[63] Continuation of application No. 08/964,317, Nov. 4, 1997, which is a continuation of application No. 08/612,830, Mar. 15, 1996, abandoned, and a continuation of application No. PCT/AU94/00639, Oct. 20, 1994.

[30] Foreign Application Priority Data

Oct. 21, 1993 [AU] Australia ..... PM 1949

[51] Int. Cl.[7] ..... F02M 51/00; F02D 31/00

[52] U.S. Cl. ..... 123/357; 123/492; 123/493

[58] Field of Search ..... 123/357, 478, 123/492, 493, 494

[56] References Cited

U.S. PATENT DOCUMENTS

| | | | |
|---|---|---|---|
| 4,244,023 | 1/1981 | Johnson | 123/492 |
| 4,266,275 | 5/1981 | Marchak | 123/492 |
| 4,428,343 | 1/1984 | Schweikert | 123/425 |
| 4,502,437 | 3/1985 | Voss | 123/357 |
| 4,729,354 | 3/1988 | Tominaga et al. | 123/320 |
| 4,909,224 | 3/1990 | Nishiyama et al. | 123/492 |
| 5,025,380 | 6/1991 | Wataya et al. | 123/492 |
| 5,297,525 | 3/1994 | Krebs et al. | 123/492 |
| 5,522,367 | 6/1996 | Reuschenbach et al. | 123/492 |

FOREIGN PATENT DOCUMENTS

| | | |
|---|---|---|
| 0 433 671 | 6/1991 | European Pat. Off. . |
| 41 20 000 | 12/1992 | Germany . |
| 40 02 407 | 3/1994 | Germany . |

*Primary Examiner*—Thomas N. Moulis

*Attorney, Agent, or Firm*—Nikaido, Marmelstein, Murray & Oram LLP

[57] ABSTRACT

A method of controlling the mass of fuel delivered to a direct injected engine subject to a change with time in engine load demand. A rate of change of fuel required per cycle of the engine in response to the change in engine load demand is determined. A filter constant is applied to the determined rate of change of fuel required to maintain a value of the rate of change of fuel required at no greater than a predetermined threshold level. The application of the filter constant is dependent upon at least one parameter selected from the group consisting of engine gear, clutch position, vehicle road speed, engine load and engine speed.

36 Claims, 4 Drawing Sheets

ECU
9
RPM
10
PEDAL POT POSITION
11
12
13
RPM
FPC DEMAND
PEDAL POT POSITION
ROAD SPEED
16
ROAD SPEED
BASE FILTER CONSTANT
FPC DEMAND
15
BASE
FILTER CONSTANT (B)
dFPC/dt
14
17
TRUE FILTER CONSTANT
B
dFPC dt
18
TRUE FILTER CONSTANT
19
30
20
28
29
A/F DEMAND > A/F CENSORED
21
FPC DEMAND
25
FPC CENSORED = $M_A$ x A/F CENSORED
FPC CENSORED
26
$M_{AIR}$
22
21

CONTROL OF FUELING RATE OF AN ENGINE

CROSS REFERENCE TO RELATED APPLICATIONS

This application is a continuation of U.S. patent application Ser. No. 08/964,317, filed Nov. 4, 1997, now abandoned, which is a continuation of U.S. patent application Ser. No. 08/612,830, filed Mar. 15, 1996, now abandoned, and a continuation of PCT/AU94/00639 filed Oct. 20, 1994. The subject matter of appliction Ser. No. 08/964,317 and application Ser. No. 08/612,830 is hereby incorporated by reference.

This invention relates to the control of the amount of fuel delivered to a fuel injected internal combustion engine, and in particular, an internal combustion engine that is subject to a sudden variation in torque demand, such as may occur during driving conditions in an automobile or other vehicle.

Occasions may occur during the driving or operation of a vehicle, where the engine speed is caused to rapidly increase or decrease. This may be due to the driver demand or may result from the engine's control system as may occur, for example, during automatic gear changing. The acceleration or deceleration may have the effect of increasing or decreasing the fuel requirement of the engine in a manner which may contribute to under-fuelling or over-fuelling of the engine during several engine cycles. This under-fuelling or over-fuelling may lead to less than optimum engine performance.

Also, due to the conventional practice of isolating the engine from the support structure of the vehicle by relatively compliant isolation mounts, commonly referred to as engine mounts, the acceleration or deceleration, especially if sudden, may cause a large movement of the engine relative to the vehicle chassis due to the torque reaction thereof which is typically followed by an impact at the engine mount(s) when the full compliance of the mount(s) is taken up. Such large movement and impact at the engine mount(s) is undesirable from the point of view of driver and/or passenger comfort and places stresses on the engine mount (s) that are better avoided. This phenomenon is commonly referred to as "lip-in" or "tip-out".

The effects of tip-in/tip-out are normally more pronounced in vehicles in which the engine, gearbox and final drive are supported on common mounts, such as is the practice in conventional front wheel drive applications. By mounting the engine/gearbox assembly on common mounts, the torque reaction to be taken tip by the mounts consists of the torque produced at the gearbox output shaft. The torque that is produced at the gearbox output shaft when such engine/gearbox assemblies are mounted via common mounts may typically be of the order of 3 to 4 times greater than the torque generated at the engine flywheel.

Further, the effects of tip-in/tip-out will generally be more pronounced in engines which are able to provide a quick response to changes in driver demand. For instance, the applicant's stratified-charge, air-assisted, direct fuel injected two-stroke engines are particularly responsive to rapid changes in load demand, such as may be required by the driver. These engines differ from conventional homogeneous charge engines in that the driver demand controls the engine's fuelling rate rather than the airflow to the engine as would normally be the case. Thus the inherent inertia and other lags associated with air-flow controlled engines essentially do not have the same effect on the applicant's engine. Accordingly, it may be desirable, in some instances, to apply a damping function to this response whilst under other situations allowing the driver the full benefit of the brisk response of the engine.

Whatever the mode of operation of the engine, the above mentioned problems are particularly prevalent in the low speed range of engine and vehicle operation, for example, during city driving wherein the nature of the engine load demand change is likely to be sudden and of short duration typically followed shortly thereafter by a return to low speed operation. Particularly in these circumstances, mis-fuelling of the engine can have undesirable consequences. In contrast, if a sudden change occurs during higher speed operation, the effects are likely to be less detrimental because the higher speed operating condition is likely to be maintained for a longer period of time with any mis-fuelling having an effect that is compensated over a period of many cycles of engine operation.

The present invention is aimed at providing a method of controlling fuel delivery to an engine during the above-described conditions wherein the above problems are overcome or substantially reduced.

With this object in view, the present invention provides a method of controlling the mass of fuel delivered to an engine subject to a change in engine load demand comprising determining a rate of change of fuel required per cycle with time in response to the change in engine load demand; and, applying a filter constant to the determined rate of change of fuel required per cycle with time to maintain a value of said determined rate of change of fuel required per cycle of the engine with time at no greater than a predetermined threshold level.

Conveniently, the method may be implemented in a fuel based control system in which the operator does not directly control the fuelling to the engine but merely generates a signal ("demand" signal) which indicates the operator's requirements (e.g. increase or decrease in power output from the engine). This demand signal may then be processed by an Electronic Control Unit (ECU) which determines the fuel and air flow requirements of the engine. Hence, the operator "demand" signal, conveniently determined as a function of accelerator pedal position, is input to the ECU which outputs the required fuel per cycle demand of the engine and controls fuel delivery accordingly. The rate of change of fuel per cycle with time may be measured in accordance with the invention and then filtered, that is, multiplied by a filter constant to reduce the rate of change of fuel per cycle with time to no greater than a predetermined threshold level that causes a degree of engine movement that is uncomfortable to a typical driver or operator of the engine and/or is adverse to the life of the engine mounts. The threshold level may be time variant and may be determined statistically or may take account of mechanical features such as the life or durability of the engine mounts or otherwise.

Conveniently, the ECU may be configured to change the engine load demand independently of driver action, such as is desirable during gear ratio changes in an automatic transmission gearbox. In this way, the invention is also applicable to non-driver initiated load demand changes.

Conveniently, the filter or damping constant required will be stored within a look-up table provided with preset values for particular rates of change of fuel per cycle with time under particular engine speed and load conditions. In this manner, the ECU provides the appropriate filter constant in accordance with engine operating conditions. Further, the look-up table which stores the filter or damping constants or intermediate look-up tables which may be required to generate inputs for this filter constant look-up table may advantageously be made dependent on the sensed road speed of the vehicle. The sensed road speed of the vehicle is itself dependent on, and may be calculated, if required, together with other engine operating parameters, from engine speed and load. Further, it is known to calculate the particular gear a vehicle is in by way of the engine speed and the road speed of the vehicle. Therefore, as with the road speed of the vehicle, the look-up table may be made dependent on the gear that the vehicle is in.

Conveniently, the look-Lip table which stores the required filter or damping constant may be arranged to be adaptive with respect to time. Accordingly, if a particular selected filter constant results in, for example, an unsatisfactory engine operating condition, each of several times that the filter constant is applied to a required fuel per cycle demand of the engine, the filter constant may be incremented upwardly or downwardly as is appropriate and substituted for the filter constant value previously stored within the look-up table.

Similarly, the determined rate of change of fuel required per cycle with time may be constant (a linear function of fuelling with time) or may be time variant. Where time variant, the ECU may calculate a function representative of the variation in the rate of change of fuel per cycle with time for the engine.

Conveniently, the filtering or damping of the rate of change of fuelling rate of the engine as demanded by the driver or ECU is instantaneous. This is particularly advantageous in a fuel based control system where, as previously mentioned, there is typically less inertia and lag than in a typical air based homogeneous charge control system. In other words, a fast filtering or damping response is necessary in a fuel based control system to obtain the desired effect of smoothing changes in the rate of fuelling and/or varying a value of the rate of change of fuel delivered per cycle of the engine to no greater than a predetermined threshold level.

However, the degree of filtering, as with the determined rate of change of fuelrequired per cycle with time, may be time variant to take account of features such as the behavior of the engine mounts. It is apparent that the movement of the engine will be most severe at onset of tip-in/tip-out where the engine mounts are typically at their most compliant. As the movement of the engine becomes more pronounced the compliance of the mounts generally decreases. Thus the degree of filtering may be varied to take account of this and the filter constant can be initially calculated to ensure a smaller rate of change of fuelling for the engine when the mounts are at their most compliant. Thereafter, recalculation of the filter constant can occur to increase the rate of change of fuelling and enable a more rapid approach to the demand fuel per cycle with time because the increasing stiffness or decreasing compliance of the engine mounts will tend to offset the likelihood of occurrence of undesirable levels of tip-in/tip-out behavior. Such recalculation of the filter constant may occur stepwise or more gradually.

The method of the invention is conveniently implemented in tandem with those inventions disclosed in the applicant's co-pending patent application Nos. AU 34862/93 and PCT/AU94/00360, the contents of which are incorporated herein by reference.

In a further aspect, the invention provides a system for implementation of the above described method and, in particular, a fuel control system for an engine subject to a change in engine load demand comprising a control unit provided with means for determining a change in engine load demand; means for determining a rate of change of fuel required per cycle of the engine with time in response to said determined change in engine load demand; and means for determining a filter constant to be applied to said determined rate of change of fuel required per cycle of the engine with time to adjust a value of the rate of change of fuel required per cycle with time for the engine to a filtered value which is equal to the value of the filter constant multiplied by the determined rate of change of fuel required per cycle with time and which is no greater than a predetermined threshold level.

The means to determine the filter constant may provide an appropriate filter constant in accordance with sensed engine operating conditions. For example, the filter constant may be determined in response to sensed engine speed, sensed engine load, the sensed road speed of a vehicle within which the engine is mounted and/or a sensed change in gear of the vehicle. In this way, the filter constant is a function of parameters which may affect the operation of the engine and hence the "driveability" of the vehicle within which the engine is mounted and thereby provide better compensation for any tip-in/tip-out behavior of the engine.

Notwithstanding the above, the filter constant may be made dependent upon other sensed engine operating parameters. For example, as the filter constant may require to be compensated for particular air/fuel ratio requirements of the engine, air intake flow and fuel flow sensors may also be incorporated within the system for example, as part of the means for determining the filter constant. The means for determining the filter constant forms part of a, generally electronic, control unit which constitutes a key component of the system. Appropriately programmed control units and desired sensors may be supplied or arranged for installation in vehicle or other engines.

The invention will be more clearly understood from the following description made with reference to the drawings in which.

Figure 1:
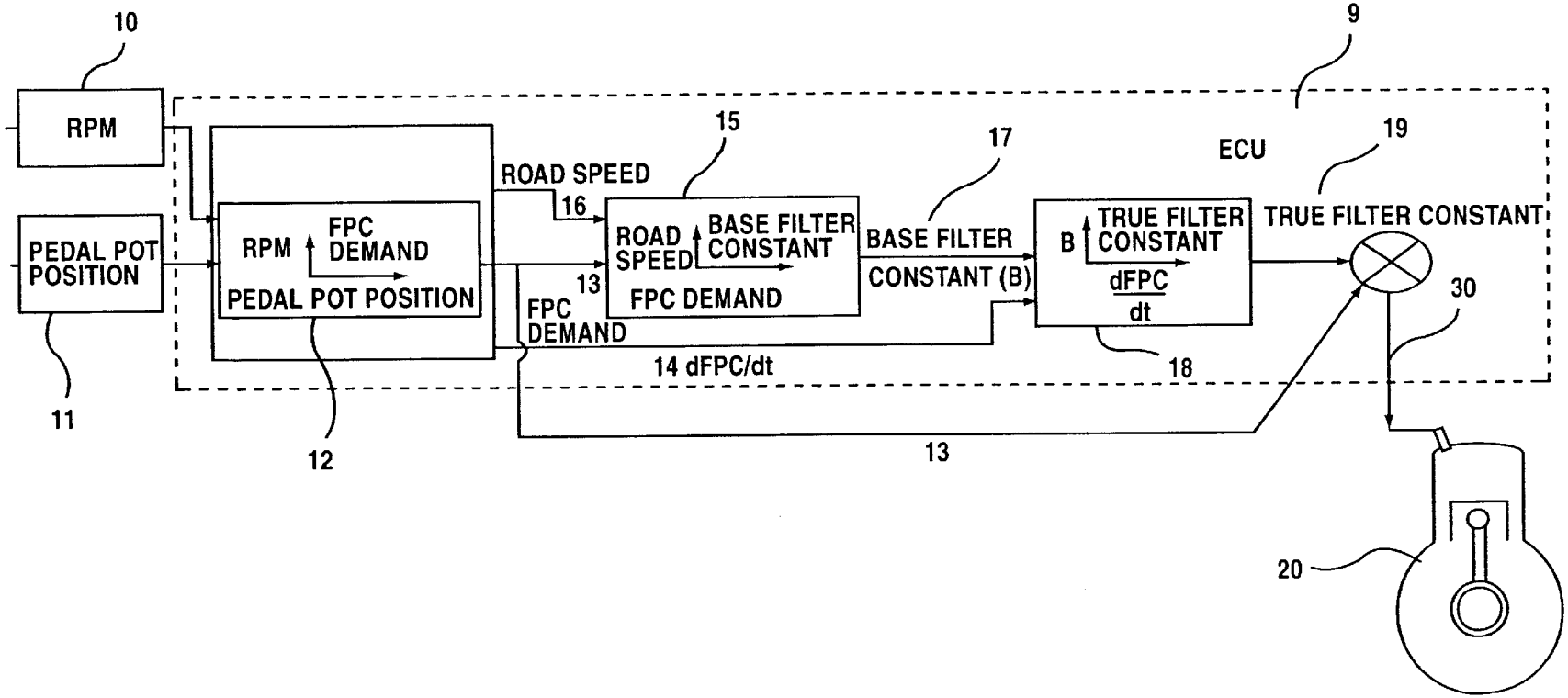
FIG. 1 is a schematic diagram of an engine management system according to a first embodiment of the invention.

Referring now to FIG. 1 of the drawings, there is depicted diagrammatically the method of operation of an engine management system to control fuelling to a vehicle engine in accordance with the method above discussed. The portion of the diagram within the dotted outline consists of part of an electronic control unit (ECU) 9 forming a key component of an engine management system, ECU controlled engine management systems per se being known in the art. The ECU 9 receives signals indicating the engine speed from the engine speed sensor 10 and engine load demand from the load demand sensor 11, the latter typically being indicated by the position of a potentiometer attached to the driver operated throttle pedal. Both input signals are advantageously filtered to remove noise and avoid hunting. It should also be noted that the ECU 9 may be arranged to alter the engine load demand independently of the driver operated throttle pedal and hence the load demand sensor 11 may be configured to equally sense such non-driver initiated signals.

The ECU 9 is capable of determining the rate of change of engine speed with respect to time and the rate of change of engine load demand with respect to time from the aforementioned signals. Also, as previously mentioned, the ECU 9 may be adapted to receive signals indicating the vehicle road speed from an appropriate road speed sensor, if desired, or may in fact generate such signals from other sensed or inputted engine operating parameters. Alternatively, or additionally, a signal indicating the gear in which the engine is engaged may be input to the ECU 9. The "gear signal" may indicate whether enablement of the filtering routine is actually required. As with the vehicle road speed, the gear signal may be calculated as a function of engine operating parameters, such as for example, road speed and engine speed. Then, for example and by analogy, at low gear and low engine speed conditions, filtering of the rate of change of fuelling (ie: $^{dFPC}/_{dt}$) is more likely to be required.

It should be noted that it is desirable to employ road speed as an input variable to the ECU 9 or a variable generated by the ECU 9 such that the method of operation of the engine management system is less compromised. That is, depending upon vehicle road speed, filtering of the rate of change of fuelling of the engine may be too aggressive or insufficient due to the fact that, depending upon what gear the vehicle is in, it is possible to have the same fuelling rate for a number of different vehicle speeds. For example, at low road speed and low engine speed, a sudden increase in the engine load demand followed by a sudden decrease in the engine load demand would typically result in undesirable tip-in/tip-out behavior. Such a situation may typically correspond, for example, to a brief acceleration in low gear such as may be likely when maneuvering in a car parking area. Accordingly, this situation is one in which it is highly desirable to adopt heavy filtering of the rate of change of fuelling to avoid tip in/tip out.

In contrast, at high vehicle road speeds and low engine speeds, such as would be experienced when cruising at relatively high speed, a large amount of filtering may not be desirable or required as the "tipping-in" or "tipping-out" behavior of the engine may not in fact be that noticeable to the driver due to other factors such as the vehicle inertia. Other situations which may occur include the situation where a vehicle is being driven aggressively corresponding to high engine speeds. In such situations, it may be undesirable to filter the rate of change of fuelling of the engine as this may compromise the performance of the engine to the dissatisfaction of the driver.

It is also important to note that, typically, a large amount of filtering is not desirable during gear changes and, in some circumstances, no filtering is desirable during gear changes. For instance, during a normal gear change event, the driver of a vehicle depresses the clutch whilst "backing-off" on the fuelling such that the engine speed drops until another gear ratio is selected and the clutch is disengaged together with load demand being applied. If a filtering routine to vary the rate of change of the fuelling rate for the engine with time was enabled, when the driver depressed the clutch or "backed-off" the accelerator pedal during a gear change event, the engine ECU might detect this as a possible tip-in condition and hence filter the rate of change of fuelling. If this occurred, rather than the engine speed dropping, the engine would "hang" in speed. In fact, the engine speed might increase due to the fact that the load from the gearbox had been removed therefrom. This is undesirable as the driver may try to compensate for such an engine reaction by gear changing action. Any wastage in fuel that results from such unnecessary increase in fuelling is undesirable.

Accordingly, it may be appropriate for the filtering routine to be made dependent upon a signal from a clutch switch such that no, or a reduced level of filtering can take place during a driver gear change event. Obviously, if no clutch signal was received, the ECU would treat any other reduction as a possible tip-in or tip-out situation and apply the filtering accordingly. It should be noted that similar compensation would be equally applicable no matter whether a clutch signal is received whilst commencing or completing a gear change event.

Referring again to FIG. 1, based on the engine speed 10 and the operator demand or engine load demand as indicated by the pedal potentiometer position 11, a fuel per cycle or FPC demand look-up table or map 12 produces a signal indicating the demand fuelling rate per cycle (FPC demand) 13 of the engine 20. From this FPC demand map 12, the ECU 9 is also able to calculate the rate of change in fuel demand per cycle of the engine with time ($^{dFPC}/_{dt}$) 14. Conveniently, this value is determined by taking two FPC demand readings over a predetermined time interval where the time interval is the time between the recordal of the two FPC demand values. Conveniently, the two FPC demand values mentioned will be the demand FPC as determined as a function of a new pedal position and the preceding demand FPC.

The signal 13 indicating the demand fuelling rate (FPC demand) of the engine 20 is input to a second look-up table or map 15 together with a road speed signal 16 from which a base filter constant (B) 17 is calculated. The road speed signal 16 is calculated by the ECU 9 from sensed or known engine operating parameters. The base filter constant 17 and the actual rate of change of fuelling rate ($^{dFPC}/_{dt}$) 14 are then input to a third look-up table or map 18 which provides, if necessary, a true filter constant value 19. This true filter constant 19 is then applied to the original demand FPC value 13 such that a filtered or damped FPC value 30 is generated and can be input as an operation control parameter for the engine 20. This "true" filter constant value 19 is appropriate for the particular value of $^{dFPC}/_{dt}$ such that the rate of change of fuelling to the new value for demand FPC is reduced to a desired level (i.e: a level which is below a predetermined threshold level of $dFPC/_{dt}$ and which avoids undesirable tip-in/tip-out behaviour).

This controlled rate of change of the demand FPC will not result in misfuelling of the engine 20, yet provides satisfactory fuelling for an acceptable level of acceleration or deceleration as the case may require. To this end, the map 18 which calculates the true filter constants is provided with predetermined filter constants found satisfactory for the particular dFPC/dt demanded by the driver or operator or the ECU 9. This improves the driveability of the vehicle as the movement of the engine 20 and any resultant impact at the engine mount(s) is controlled to an acceptable or more desirable level. The filtering of the demand FPC signal 13 is instantaneous and continues until the acceleration or deceleration is complete.

Figure 2:
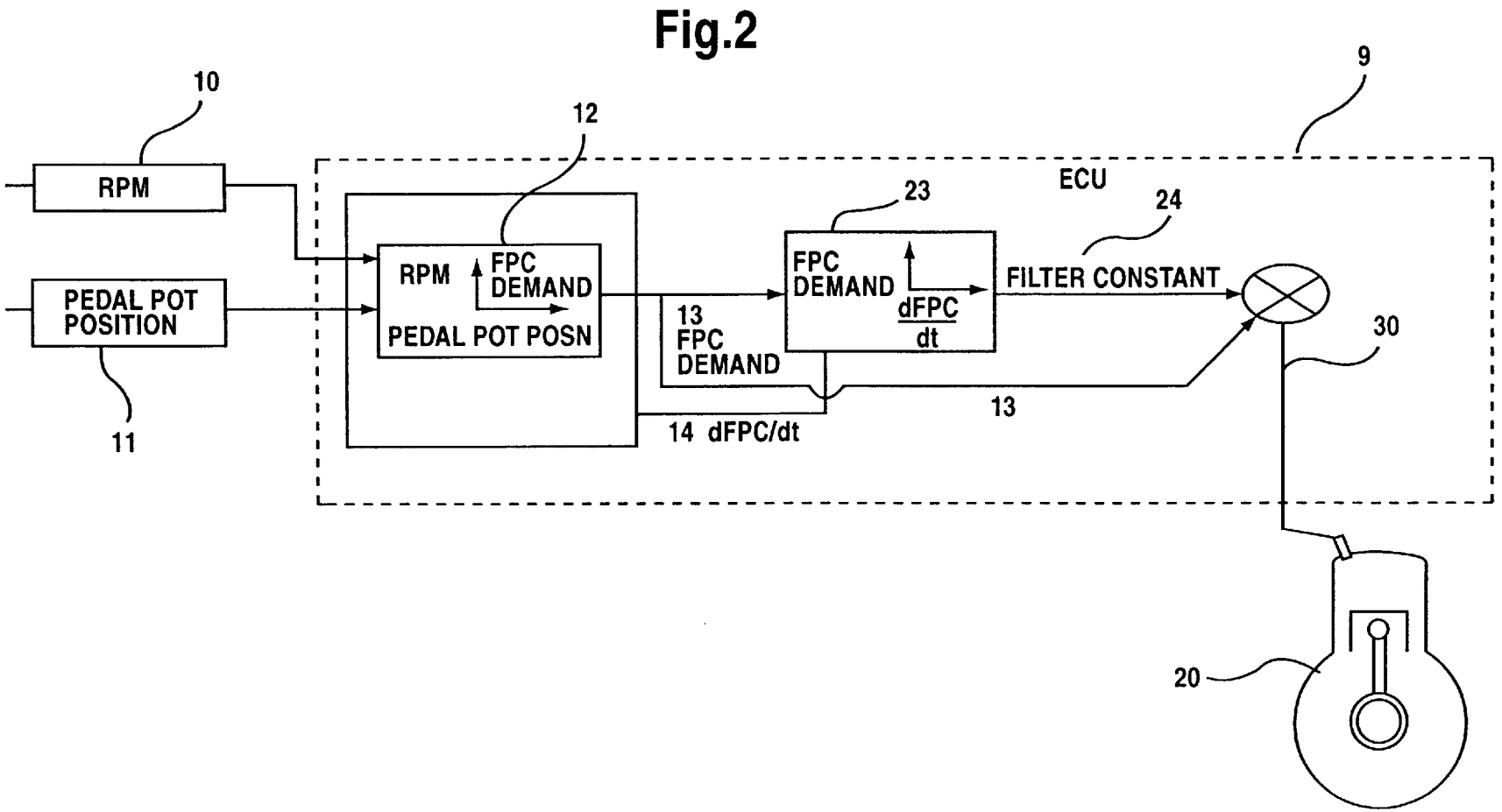
FIG. 2 is a schematic diagram of an engine management system according to a second embodiment of the invention.

In an alternative embodiment, there may be provided a system in which road speed is not taken into account, and/or which is only initiated in response to certain engine operating conditions as established by or programmed into the ECU 9. Such a system is shown in FIG. 2. Its operation may be briefly described as being in accordance with that described with reference to FIG. 1, without a correction for road speed. In such an arrangement, the second map 15 is not required. In this case, a base filter constant 24 is produced by a look-up table or map 23 as a function of the rate of change of fuelling ($dFPC/_{dt}$) 14 and fuel demand 13 alone. The base filter constant 24 is then applied to the original fuel demand or demand FPC 13 such that the filtered or damped FPC value 30 is generated and can be input as an operation control parameter for the engine 20.

Figure 3:
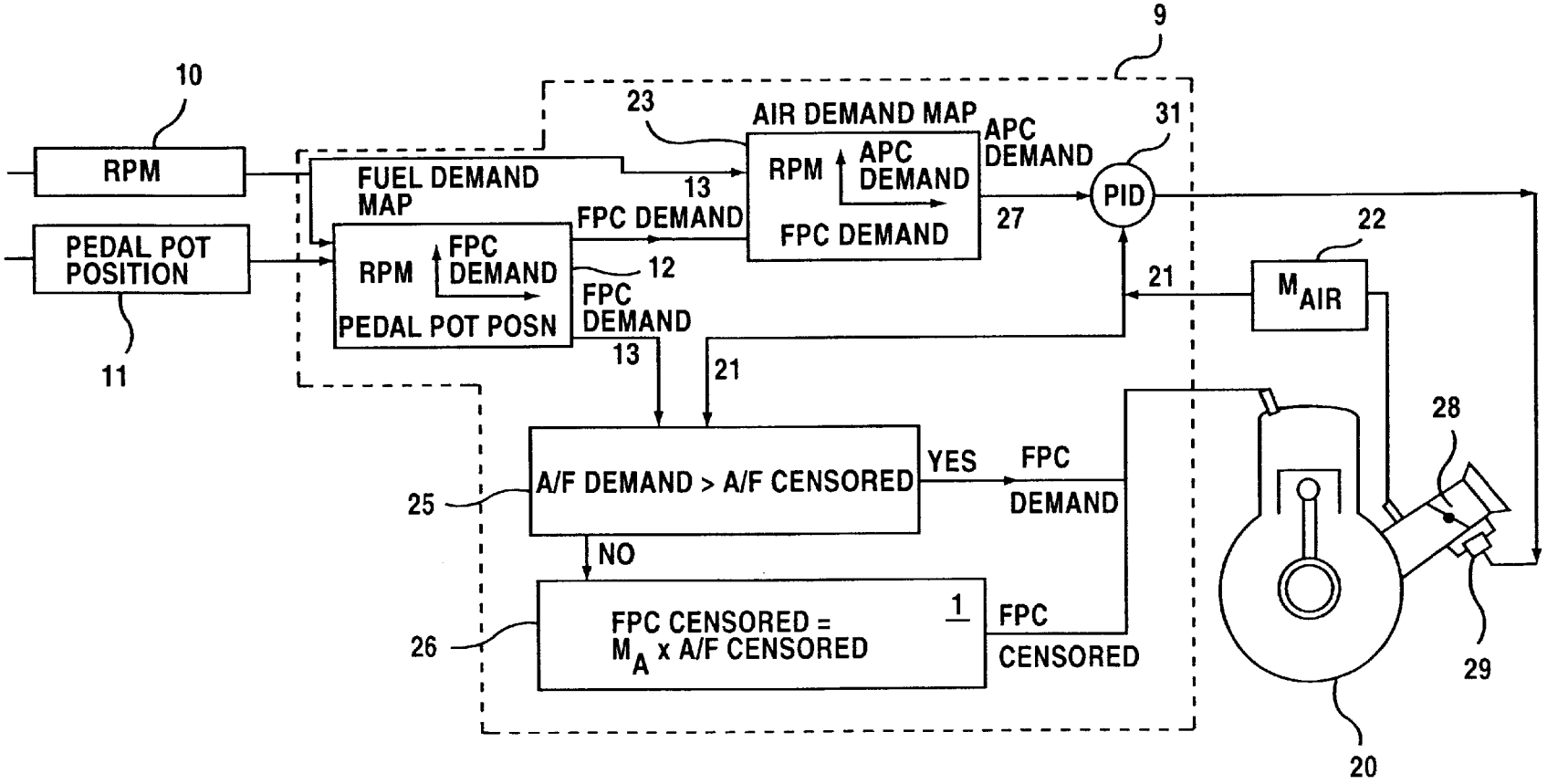
FIG. 3 is a schematic diagram of an engine management system according to the prior art.

In the applicant's co-pending Australian Patent Application No. AU 34862/93 is described a method for controlling the mass of air and fuel delivered to an internal combustion engine per cylinder per cycle. In that disclosure, the control system is as shown in FIG. 3 thereof. Referring now to FIG. 3 hereof, which is similar to FIG. 3 of the above identified patent application, during normal operation of the engine 20, the FPC demand map 12 produces a signal 13 indicating the fuel per cycle demand of the engine 20. The signal 13 indicating the fuel per cycle demand of the engine 20 is input to the air demand map 23 which determines the air per cycle demand 27 for that particular fuel per cycle demand 13 (having regard to the engine speed). An air mass sensor 22 then measures the actual air per cycle 21 being delivered to the engine 20 for the current position of the throttle valve 28 and bypass valve 29. If the air per cycle demand 27 as indicated from the air demand map 23 does not correspond with the actual air per cycle 21 being delivered to the engine 20, the air bypass valve 29 is activated to effect the necessary correction. This is typically achieved by way of a PID controller 31.

The fuel per cycle 13 and actual air per cycle 21 signals are also provided as inputs to an air/fuel ratio comparator 25, wherein the actual air/fuel ratio based on these inputs is compared with a censored air/fuel ratio which is preset on the basis of engine load demand or pedal position and engine speed. The censored air/fuel ratios are stored in a map and will normally be a range between maximum or minimum predetermined limits. The demanded air/fuel ratio is not to exceed the censored air/fuel ratio limits, so that, for example, the rich misfire limit of the engine is not exceeded. If the air/fuel ratio, as determined by the demand fuel per cycle 13 and the actual air per cycle 21, differs from the censored air/fuel ratio by more than the permissible amount, then a correction module 26 is enabled such that correction will he made to the fuel per cycle delivered to the engine 20, so that the air/fuel ratio will be within the permissible variation from the censored air/fuel ratio.

Figure 4:
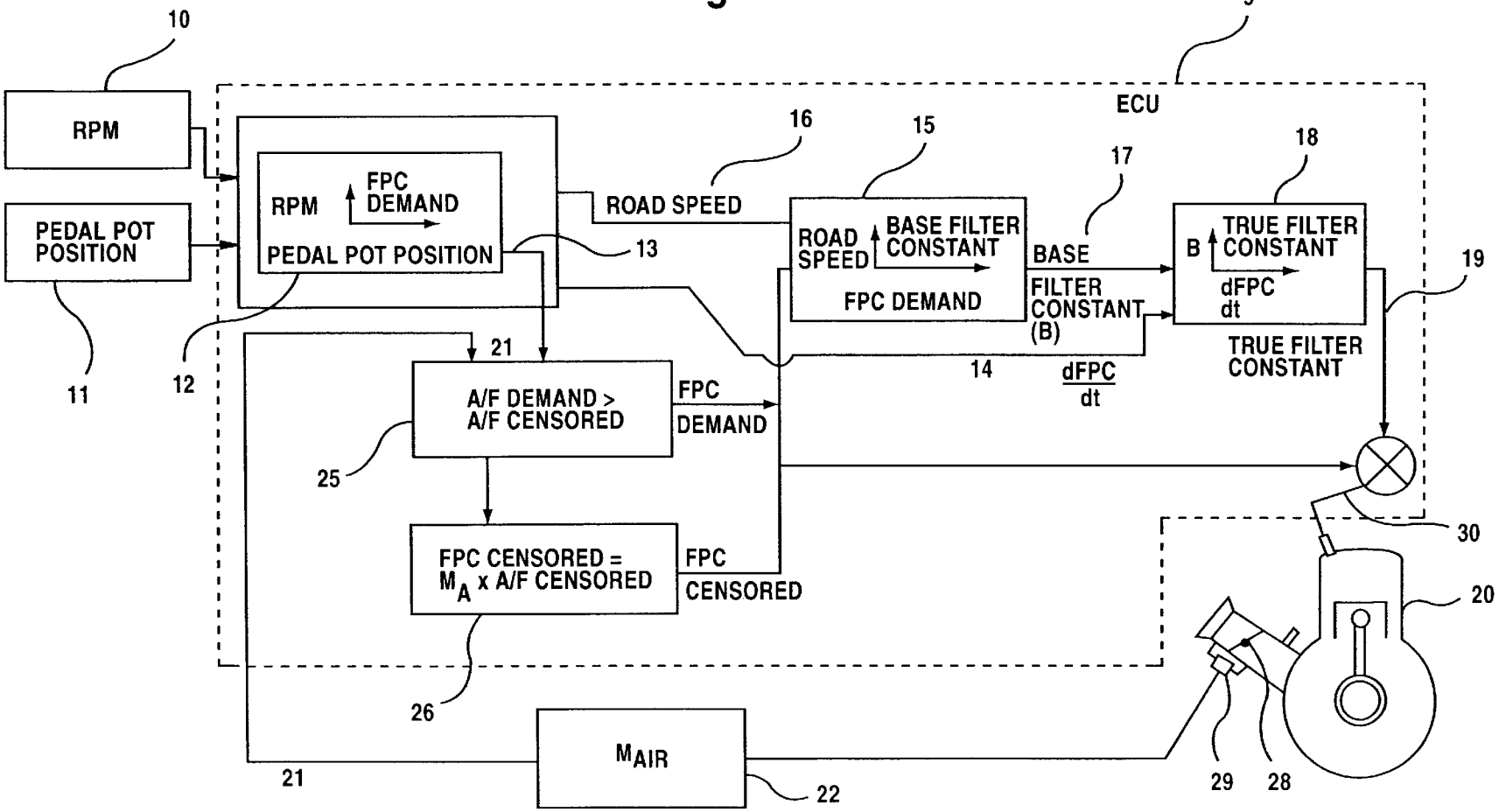
FIG. 4 is a schematic diagram of an engine management system incorporated in a "fuel based control" system according to a third embodiment of the invention.

Hence, in consideration of the present invention, where there is a sudden change in pedal position at low road speed, for example, the rate of change of the censored fuel demand per cycle ($dFPC/dt_{censored}$) can be input to the base filter constant map 15 which provides a base filter constant 17 appropriate for the particular value of $dFPC/dt_{censored}$ such that the rate of change of fuelling dFPC/dt 14 is reduced to a manageable level as discussed above with reference to FIG. 1. This is shown in FIG. 4. However, the system may also be configured such that, if the rate of change of fuel per cycle dFPC/dt 14 exceeds a certain threshold value even at high road speed, the filtering routine can still he enabled. In this regard, it is cogent that the object of the filtering routine is improved driver comfort and the system is to be configured to achieve that end.

The values of the filter constants may be adaptive with time such that if, for instance, a selected filter constant 19, 24 results in rich misfire of the engine 20, as sensed, for example, by a combustion chamber pressure transducer, each of several times that the filter constant 19, 24 is applied to a specific FPC demand value 13, the filter constant 19, 24 may be incremented downwardly as required and substituted for the filter constant value previously held in the filter constant map 18, 23. In this way, the desired filtering and thus fuelling condition of the engine 20 is maintained.

Alternatively, the filter constants 19, 24 or the filter constant map 18, 23 may be made adaptive to allow for changes or differences in the engine mounts. Thus, for example, as time progresses, wear or ageing of the engine mounts increases and the need for filtering of the rate of change of fuel per cycle (dFPC/dt) 14 consequently changes as a result of such engine mount deterioration. The ECU 9 can be programmed to take account of such factors. Further, the ECU 9 could be configured such that it is capable of adapting the filter constant map 18, 23 in respect of different engine mounts such as would be the case if the vehicle engine mounts were replaced. To this end, the ECU 9 may receive or generate signals from suitably located accelerometers or sensed crankshaft fluctuations.

Mention may be made of a system in which the described method is applied to filter changes in fuelling rate dictated by, for example, the ECU 9 independently of the actions of the driver. Referring to an automatic gearbox engine application, it will be the ECU 9 that will rapidly reduce the load demand and then re-apply the load demand so that there is a smooth transition during gear changes. Therefore, the method may be applied to control the rate of fuelling during return of the engine to a higher load demand whereas no filtering may be necessary to the reduction in fuelling of the engine 20 on the gear change.

Reference is now made to a further embodiment in which the filter constant is made a function of time, with the degree of filtering being varied to take into account the variable behaviour of the engine mounts in response to engine movement caused by a change in engine load demand.

Engine mounts are typically initially compliant to impacts or shocks exerted thereon and then become stiffer or less compliant as the mounts take up the force applied thereto by the engine. Therefore the degree of filtering of the rate of change of fuel per cycle with time can be varied to take this phenomenon into account. This is accomplished in the following manner.

Initially, when tip-in or tip-out occurs in response to a change in engine load demand, a first heavy level of filtering or reduction of the rate of change of fuelling is required to restrain or control the initial responsive movement of the engine onto its mounts; the mounts in question being the mounts that will receive the resultant force caused by the movement of the engine, whether in response to tip-in or tip-out.

In this manner, the engine is prevented from gaining sufficient momentum that would cause a resultant shock being transmitted to the vehicle via the engine mounts. Then, as the mounts commence to take up the resultant force generated by the movement of the engine—in other words, the mounts begin becoming less compliant—a greater rate of change of fuelling to the engine can be tolerated as, the initial and, typically, more substantial movement of the engine has been controlled. It follows that, after the first "compliant" phase is complete, the engine mounts have taken up a substantial proportion of the resultant force generated by this engine movement. Therefore, the filter constant can be recalculated and the degree of filtering may be reduced without the consequential increase in the rate of change of fuelling producing a significant impact or shock at the engine mounts because the stiffness of the mounts has increased to a level wherein the degree of movement of the engine does not impinge on driver comfort.

The variation in filtering achieved by recalculation of the filter constant may be stepwise or may be gradual, possibly being a function of the degree of engine movement that has occurred as determined with reference to time or monitored engine mount stiffness. Such variation in filtering can lead to better response as the filtered rate of change of fuelling can be made to more closely match that demanded by the driver or may enable achievement of the final demanded FPC at substantially the same rate or the time that the final demand FPC would have been achieved if the demanded rate of change of fuelling had been delivered without filtering.

In one method of implementation, an injection event or perhaps a time counter may be employed which is enabled when, for example, the operator demand increases suddenly, that is, from idle to wide open throttle at low engine speed which would typically result in an unacceptable level of tip-in. The ECU 9 may then provide a filter constant that causes a lower rate of change of fuelling to be obtained during the early injection events following counter enablement. The filter constant may be calculated in response to engine speed, gear and road speed or other parameters as above described such that the initial rate of change of fuelling of the engine remains below the threshold level that would cause excessive engine movement.

Then, as the engine mounts become stiffer or less compliant, the fuelling rate can be increased with reduced prospect of excessive engine movement and, consequently, the filter constant value may be varied so that the rate of change of fuelling enables a quicker approach to the final demand value as the counter increments steadily upwards.

When the final demand fuel per cycle with time is reached, the counter may be set to zero and disabled until the next tip-in/tip-out event.

The description of the invention made above is not intended to be limiting of the invention and other variations may be made by those skilled in the art without departing from the scope of the invention.

We claim:

1. A method of controlling the mass of fuel delivered to a direct injected engine subject to a change with time in engine load demand comprising determining a rate of change of fuel required per cycle of the engine in response to said change in engine load demand; and, applying a filter constant to said determined rate of change of fuel required to maintain a value of the rate of change of fuel required at no greater than a predetermined threshold level wherein application of said filter constant is dependent upon at least one parameter selected from the group consisting of engine gear, clutch position, vehicle road speed, engine load and engine speed.

2. A method of controlling the mass of fuel delivered to a direct injected engine subject to a change with time in engine load demand comprising determining a rate of change of fuel required per cycle of the engine in response to said change in engine load demand; and, applying a filter constant to said determined rate of change of fuel required to maintain a value of the rate of change of fuel required at no greater than a predetermined threshold level wherein a value of said filter constant is dependent upon at least one of engine load and engine speed.

3. A method of controlling the mass of fuel delivered to a direct injected engine subject to a change with time in engine load demand comprising determining a rate of change of fuel required per cycle of the engine in response to said change in engine load demand; and, applying a filter constant to said determined rate of change of fuel required to maintain a value of the rate of change of fuel required at no greater than a predetermined threshold level being implemented in a vehicle wherein a value of said filter constant is dependent upon the sensed road speed of the vehicle.

4. A method as claimed in any one of claims 1, 2 or 3, wherein said filter constant is provided by a look-up table in a control unit, said look-up table being provided with preset values of filter constants corresponding to particular rates of change of fuel required under particular engine operating conditions.

5. A method as claimed in any one of claims 1, 2 or 3, wherein application of said filter constant is dependent upon engine operating conditions.

6. A method as claimed in claim 2 or 3, wherein application of said filter constant is dependent upon at least one parameter selected from the group consisting of engine gear, clutch position, vehicle road speed, engine load and engine speed.

7. A method as claimed in claim 1 or 3, wherein a value of said filter constant is dependent upon engine load and/or engine speed.

8. A method as claimed in claim 1 or 2 being implemented in a vehicle wherein a value of said filter constant is dependent upon the sensed road speed of the vehicle.

9. A method as claimed in any one of claims 1, 2 or 3, wherein a value of said filter constant is dependent upon a signal generated by a change in gear of the engine.

10. A method as claimed in any one of claims 1, 2 or 3, wherein said filter constant is adaptive with time, being incremented upwardly or downwardly to generate a desired filter constant for a given engine operating condition.

11. A method as claimed in any one of claims 1, 2 or 3, wherein said filter constant is compensated for changes in the wear of engine mounts.

12. A method as claimed in any one of claims 1, 2 or 3, wherein the control unit determines a required air/fuel ratio in accordance with engine operating conditions and in accordance with which said filter constant is varied to maintain said rate of change of fuel required below said predetermined threshold value while also maintaining the required air/fuel ratio.

13. A method as claimed in any one of claims 1, 2 or 3, wherein said change in engine load demand is initiated by an operator of the engine.

14. A method as claimed in any one of claims 1, 2 or 3, wherein said change in engine load demand is independent of operator action.

15. A method as claimed in claim 13 wherein the change in engine load demand is determined as a function of throttle pedal position.

16. A method as claimed in any one of claims 1, 2 or 3, wherein the change in engine load demand is determined as a function of engine operating conditions.

17. A method as claimed in any one of claims 1, 2 or 3, wherein the application of the filter constant to said determined rate of change of fuel required is instantaneous.

18. A method as claimed in any one of claims 1, 2 or 3, wherein a value of said filter constant is varied in accordance with changes in compliance of mounts for said engine.

19. A method as claimed in claim 18 wherein, upon application of said filter constant and commencement of movement of said engine on its mounts, said filter constant is calculated to produce an initial threshold value of rate of change of fuel required, the filter constant being recalculated, as a rate of movement of said engine becomes smaller in response to decreasing compliance of said engine mounts, such that subsequent values of rate of change of fuel required are greater than said initial value enabling a more rapid approach to the fuel per cycle of the engine demanded by an operator of said engine.

20. A method as claimed in any one of claims 1, 2 or 3, wherein the rate of change of fuel required is determined directly from said engine load demand.

21. A method as claimed in any one of claims 1, 2 or 3, wherein the method is implemented in a fuel based control system.

22. A method as claimed in any one of claims 1, 2 or 3, wherein said filter constant is applied when said determined rate of change of fuel required exceeds a predetermined threshold level.

23. A method as claimed in any one of claims 1, 2 or 3, wherein said determined rate of change of fuel required is time variant.

24. A method as claimed in any one of claims 1, 2 or 3, wherein said determined rate of change of fuel required is constant.

25. A method as claimed in any one of claims 1, 2 or 3, wherein said predetermined threshold level is time variant.

26. A method as claimed in any one of claims 1, 2 or 3, wherein said engine is a direct injected engine.

27. A method as claimed in any one of claims 1, 2 or 3, wherein said engine is an air-assisted engine.

28. A fuel control system for a direct fuel injected engine subject to a change in engine load demand comprising a control unit provided with means for determining a change with time in engine load demand; means for determining a rate of change of fuel required per cycle of the engine in response to said determined change in engine load demand; means for determining a filter constant to be applied to said determined rate of change of fuel required for the engine to adjust a value of the rate of change of fuel required to a filtered value which is equal to the value of the filter constant multiplied by the determined rate of change of fuel required and which is no greater than a predetermined threshold level; and including sensors to determine values of engine operating conditions upon which the filter constant is dependent, such that the filter constant is determined in accordance with the sensed values.

29. System as claimed in claim 28, wherein said sensors include engine load and/or engine speed sensors.

30. System as claimed in claim 28 or 29, wherein said sensors include road speed sensors.

31. System as claimed in claim 28 or 29, wherein said sensors include change in gear sensors.

32. System as claimed in claim 28 or 29, wherein said sensors include means to determine wear of engine mountings.

33. System as claimed in claim 28 or 29, including air intake flow and fuel flow sensors.

34. System as claimed in claim 28 or 29, including a sensor to sense clutch position.

35. System as claimed in claim 28 or 29, wherein said engine is a direct injected engine.

36. System as claimed in claim 28 or 29, wherein said engine is an air-assisted engine.

* * * * *